US005259207A

United States Patent [19]

Mitsumoto

[11] Patent Number: 5,259,207

[45] Date of Patent: Nov. 9, 1993

[54] KNITTED PRODUCT

[75] Inventor: Shigenobu Mitsumoto, Wakayama, Japan

[73] Assignee: Shima Seiki Mfg., Ltd., Wakayama, Japan

[21] Appl. No.: 928,073

[22] Filed: Aug. 12, 1992

Related U.S. Application Data

[63] Continuation of Ser. No. 584,829, Sep. 19, 1990.

[30] Foreign Application Priority Data

Sep. 28, 1989 [JP] Japan ..... 1-254079

[51] Int. Cl.[5] ..... D04B 7/04; D04B 9/46

[52] U.S. Cl. ..... 66/64; 66/172 R

[58] Field of Search ..... 66/172 R, 64, 194, 198, 66/199, 200, 175, 176, 14

[56] References Cited

U.S. PATENT DOCUMENTS

| | | | |
|---|---|---|---|
| 2,141,440 | 12/1938 | Lawson et al. | 66/199 |
| 2,339,963 | 1/1944 | St. Pierre et al. | 66/173 |
| 2,383,350 | 8/1945 | Smetana | 66/173 X |
| 3,376,717 | 4/1968 | Scheller et al. | 66/199 |
| 3,668,898 | 6/1972 | Betts et al. | 66/176 X |
| 4,014,186 | 3/1977 | Ferraguti | 66/173 X |
| 4,750,339 | 6/1988 | Simpson, Jr. et al. | 66/172 R |

FOREIGN PATENT DOCUMENTS

| | | | |
|---|---|---|---|
| 880042 | 6/1952 | Fed. Rep. of Germany | 66/172 |
| 372569 | 7/1939 | Italy | 66/198 |

*Primary Examiner*—Clifford D. Crowder
*Assistant Examiner*—John J. Calvert
*Attorney, Agent, or Firm*—Edwin E. Greigg; Ronald E. Greigg

[57] ABSTRACT

The present invention relates to a knitting method employed at the end of knitting of a fabric knitted by using a flat knitting machine possessing at least first and second needle beds disposed in a pair of front and rear ones, and a knit fabric knitted by executing the same method.

1 Claim, 7 Drawing Sheets

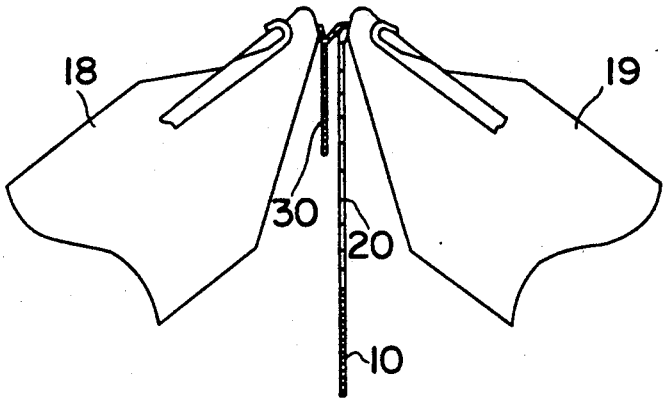
FIG. 4-A
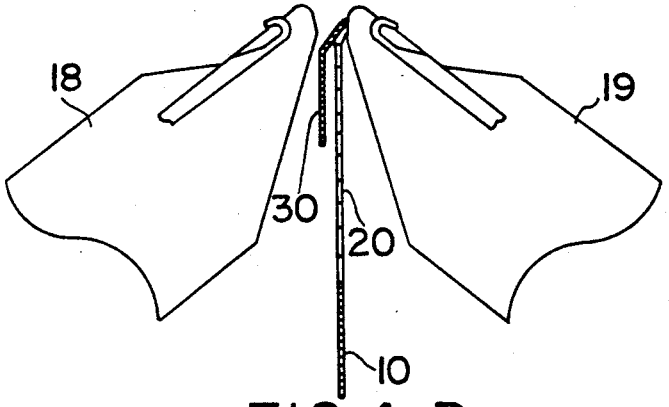
FIG. 4-B
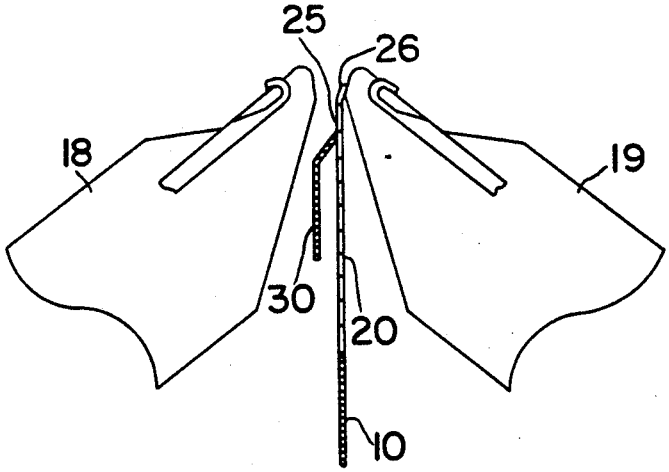
FIG. 4-C

KNITTED PRODUCT

This is a continuation of copending application Ser. No. 07/584,829 filed on Sep. 19, 1990.

BACKGROUND OF THE INVENTION

The present invention relates to a knitting method employed at the end of knitting of a fabric knitted by using a flat knitting machine, and a knit fabric knitted by executing the same method.

A knit fabric knitted by using a flat knitting machine is unraveled unless the loop in the final course is fixed. Generally, various ravelments are taken. For example, in manual procedure, hand looping known as winding stop or welting stop is employed, and mechanically, the loop of the final course is sewn to the loop of the immediately preceding course by overlock sewing, or the loops are sewn together by a looping machine.

Such procedures are, however, complicated and require experienced skill, and it takes much labor in the processing step after knitting. Accordingly, it was attempted to bond the loop of the final course of knit fabric by using an adhesive, fuse by using thermofusible thread, or contract the stitch by using a thermoelastic thread, but since the stitch appears in the final end portion of the knit product, the appearance of the knit product is spoiled.

OBJECT AND SUMMARY OF THE INVENTION

The invention is devised in the light of the above problems, and it is an object of the present invention to provide a knit fabric having a good appearance in its course terminating portion which has been knitted into a final state in the knitting process without hand looping or overlock sewing after knitting, and a knit method thereof.

BRIEF DESCRIPTION OF THE DRAWINGS

FIGS. 3-1, 3-2 and 3-3 illustrate a progressive knitting course for a knit product; and FIGS. 4A, 4B, and 4C are side views of a knit product.

DETAILED DESCRIPTION OF THE DRAWINGS

Figure 1:
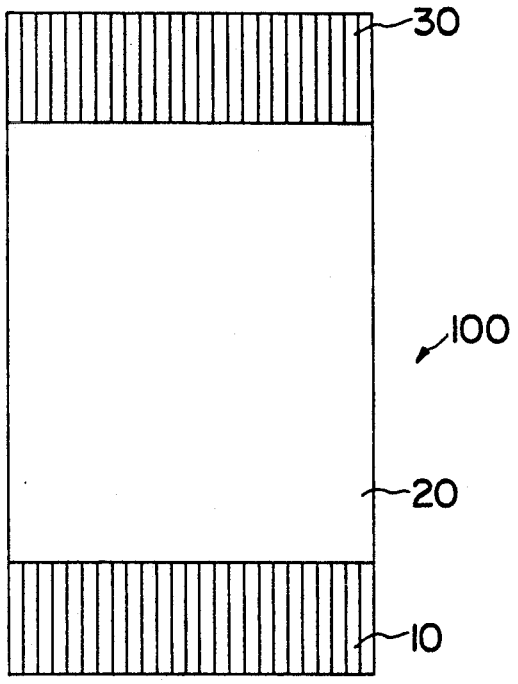
FIG. 1 is a front view of a knit product.

Referring now to the drawings, a preferred embodiment by the knit fabric and knitting method of the invention is described below.

This is an embodiment of knitting by using a flat knitting machine having a carriage comprising a pair of front and rear needle beds and a single knitting system reciprocating on the needle beds, wherein needles A, B, . . . , K, L are arranged in a row on the first needle bed 18, and needles a, b, . . . , k, 1 corresponding to the above needles A, B, . . . , K, L are disposed on the confronting second needle bed 19.

FIG. 1 shows a knit product 100 knitted by executing the method of the invention, in which there is a rib knit part knitted by a known method in the knitting start part 10 in the lower part of the course in the garment, and a main part 20 is located in the middle of the course, while a knitting end part 30 of rib knitting is found in the upper part of the course.

Figure 2:
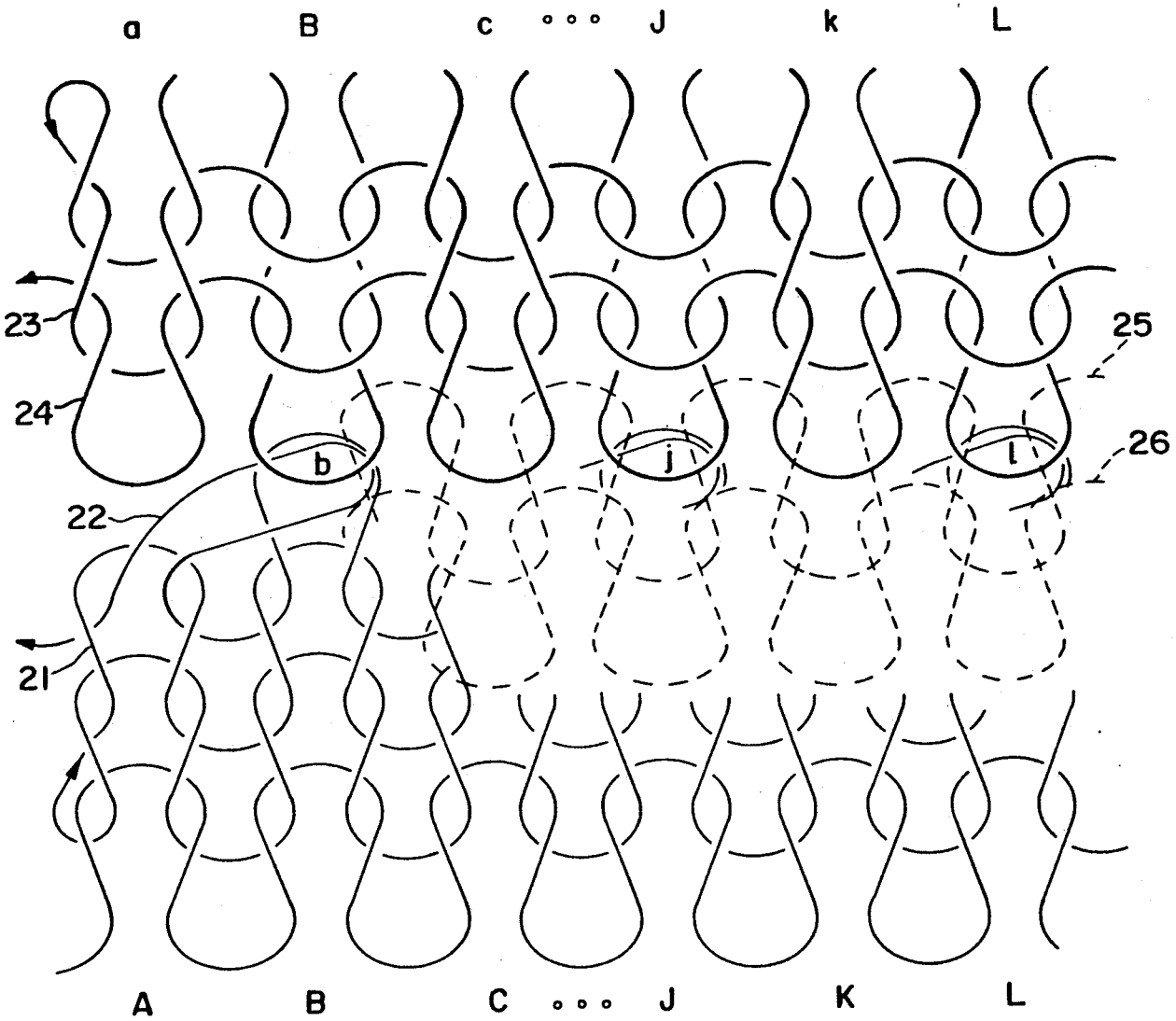
FIG. 2 illustrates an explanatory drawing of a stitch pattern of a knit product.

FIG. 2 shows a part of loop diagram of the knit product 100, in which the main part 20 is indicated by a thin line, the knitting end part 30 by a thick line, and the loop knitted after the joining of the main part 20 and knitting end part 30 mentioned below, being concealed at the lower side of the knit product by dotted line, respectively.

Figures 1, 3:
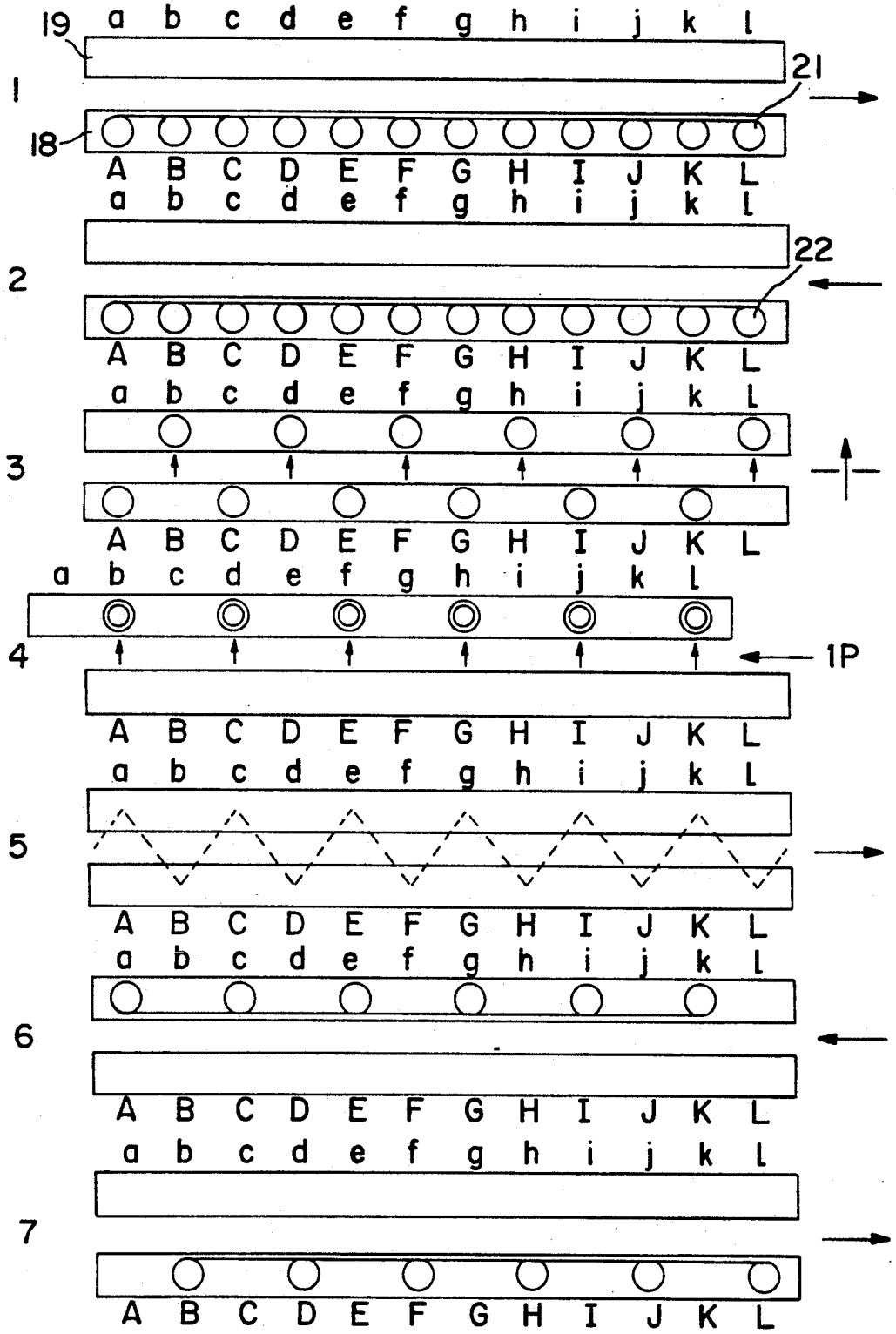
Figures 2, 3:
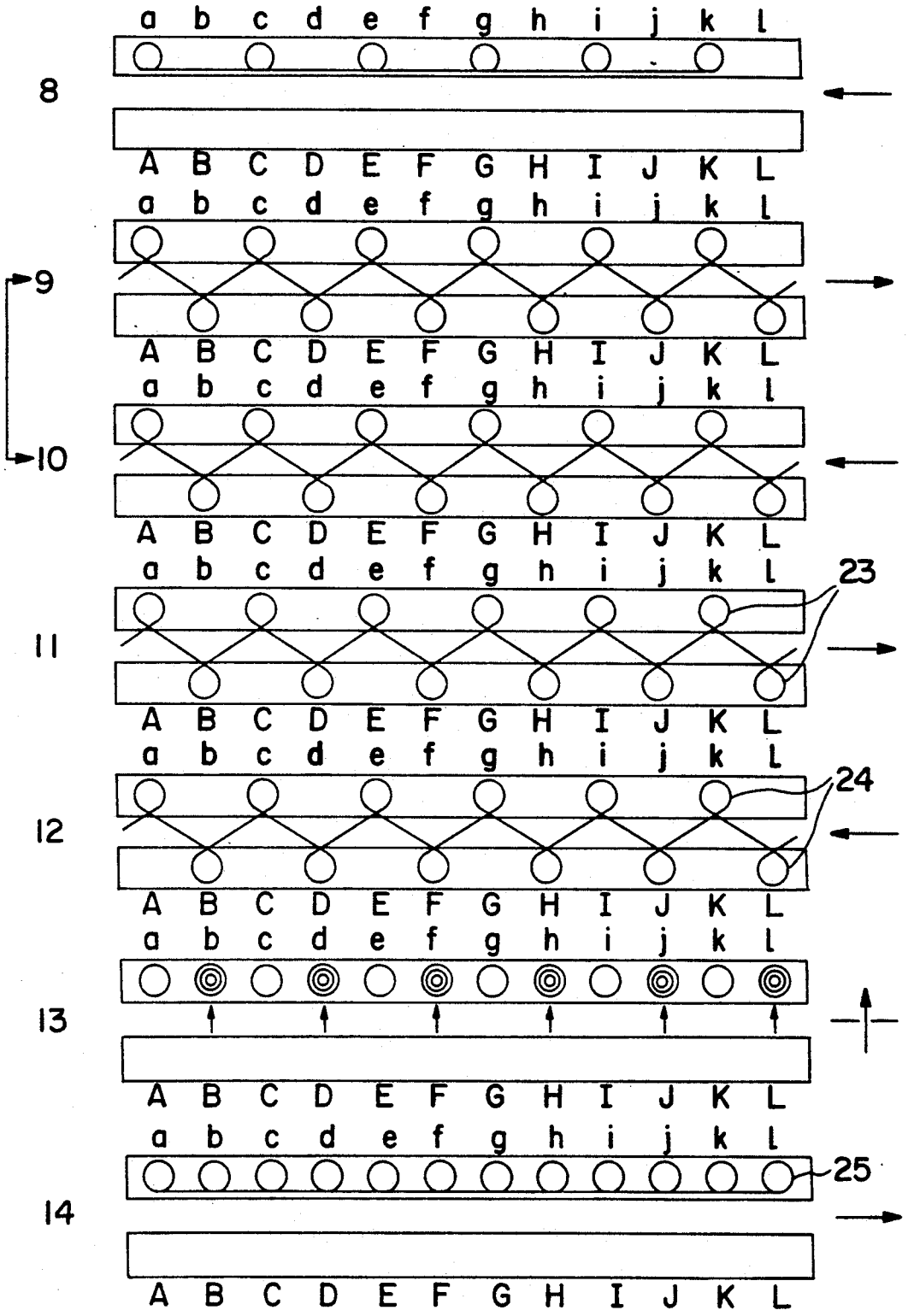
Figure 3:
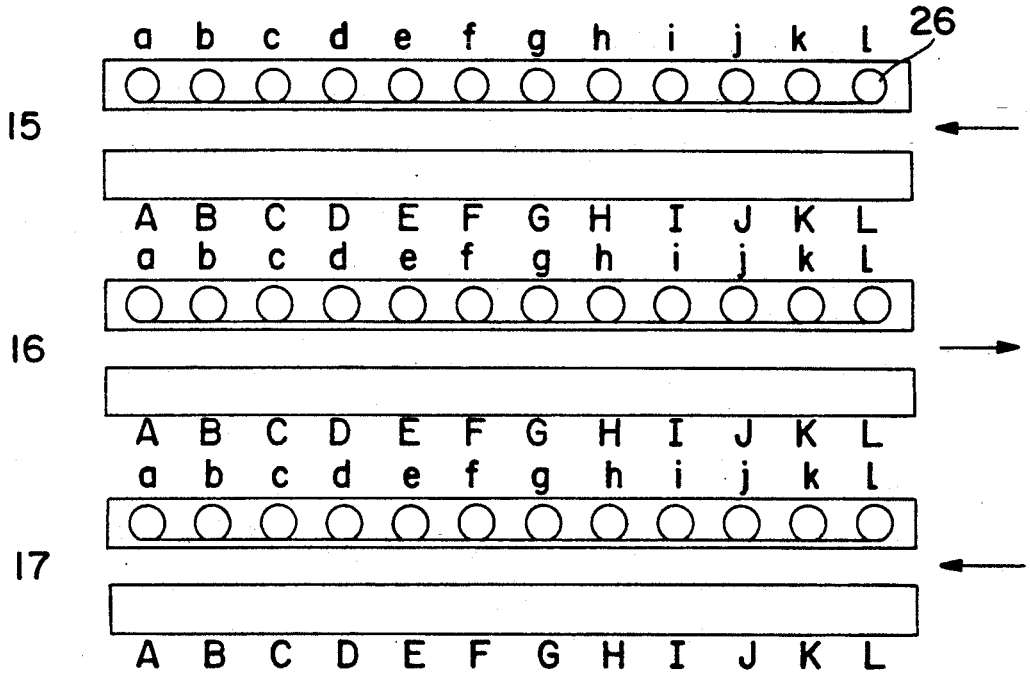
Figure 5:
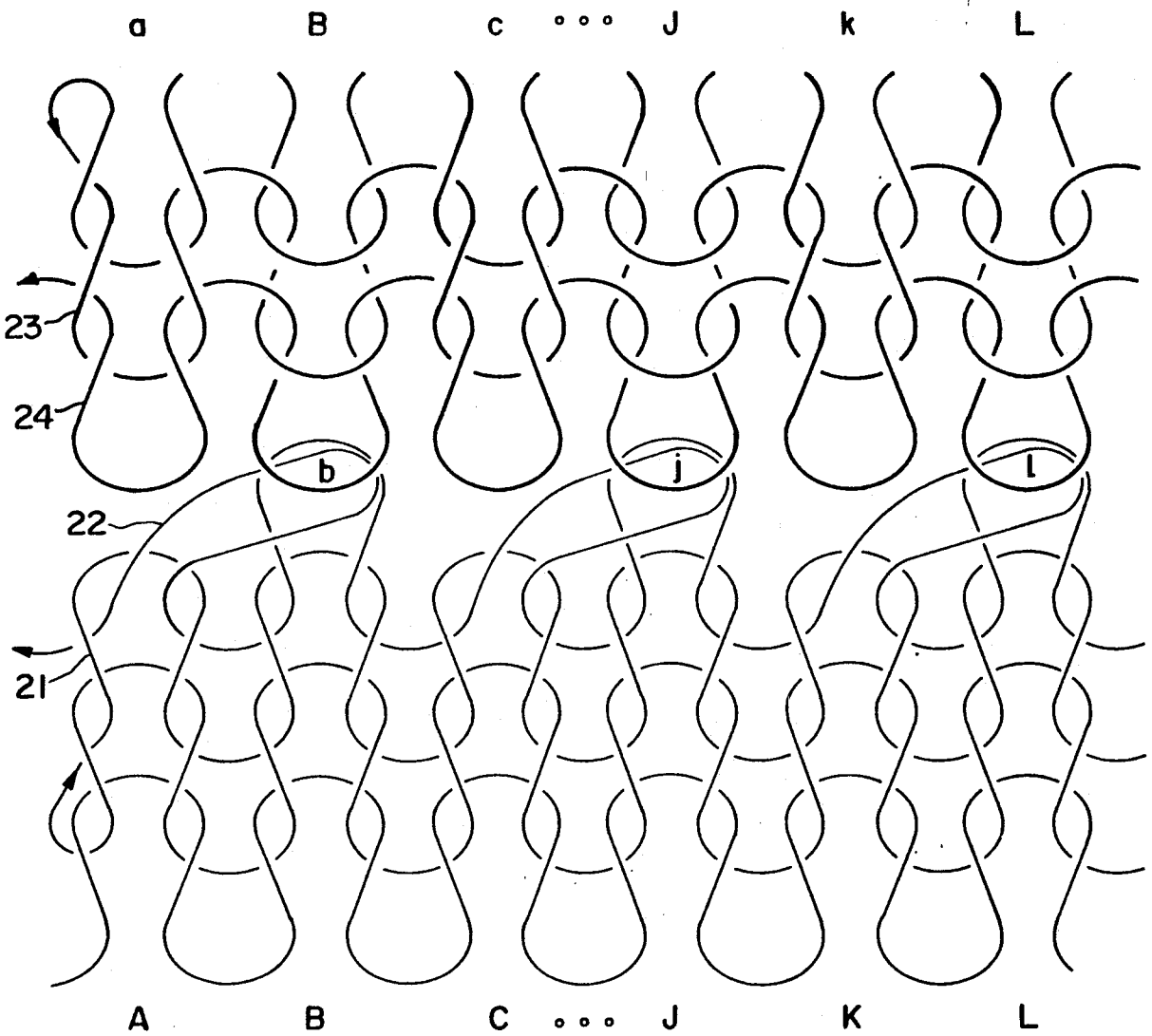
FIG. 5 illustrates the knit of FIG. 2 with some of the loops omitted.

FIGS. 3-1, 3-2 and 3-3 show knitting courses from the final two courses 11, 12 of the main part 20 to the end of all the knitting procedure for the product. Knitting courses of the knitting start part 10 and the subsequent main part 20 are not shown in these drawings because they can be knitted by a known knitting method.

In blocks 1, 2, the final loops 21, 22 of the main part 20 are knitted by means of the needles of the first needle bed 18. Depending on the design, the knitting structure of the main body 20 may be changed. After the main part 20, in block 3, the loop stopped on every other needle B, D, . . . , J, K of the needles A, B, . . . , K, L stopping the final loop of the main part 20 is moved to the needles b, d, . . . , j, l of the second needle bed 19 at the opposite end. In the next block 4, the second needle bed 19 is moved one pitch leftward and the loop on every other, needle A, C, . . . , I, K not transferred in block 3 is transferred to the needles b, d, . . . , j, l of the second needle bed 19 overlay the loops. Since it is difficult to express the state of this portion in the loop diagram, symbols b, j, l in the overlapped loops are used. With the loop of the main part 20 held stationary, the needles b, d, . . . , j, l stopped knitting.

At the end of block 4, no loop is held on the needles of the first needle bed 18. In the second needle bed 19, the every other needles a, c, . . . , i, k are blank needles which are not holding the loop.

Blocks 5 to 12 are knitting diagrams showing knitting of the rib knitting end portion 30 using the blank needles, and in block 5, using the needles B, D, . . . , J, L of the first needle bed 18 and needles a, c, . . . , i, k of the second needle bed 19, the knitting end portion 30 is knitted. In the subsequent blocks 6, 7, 8, using the same needles, the knitting is terminated. Then in blocks 9 to 12, the rib knitting parts are knitted. Here, by properly repeating blocks 9, 10, it is designed to adjust the height at the knitting end portion 30.

By such knitting, a knit fabric composed of the knitting start part 10 and the main part 20, and a knit fabric forming the knitting end part 30 as approximately shown in FIG. 4-A droops from the peak of the needle bed. In block 13, the loop 24 of the final course of the knitting end part 30 held on the needles B, D, . . . , J, L of the first needle bed 18 is transferred and overlapped on the needles b, d, . . . , j, l of the second needle bed 19 stopped in a state, to hold the loop 22 of the final course of the main part 20.

In this state, in other words, as shown in FIG. 4-B, the main part 20 and the knitting end part 30 are joined on the second needle bed 19, linked to form one knit fabric. Subsequently after knitting by the needles of the second needle bed 19 in blocks 14, 15.

As shown in FIG. 4-C, the loops 25, 26 formed in blocks 14, 15 which are positioned at the peak of the second needle bed 19 are curled due to the curling property of loops when the loops 25, 26 are released from the knitting machine and warped upward to the main part 20 side to conceal holes formed at the joining part between the main part 20 and the knitting end part 30.

Further, in blocks 16, 17, loops are formed by thermofusible thread or thermoelastic thread and the loops are heat-treated to prevent the loops 25, 26 formed in blocks 14, 15 from unraveling. In this way, the knit product will be completed. A knitting pattern of blocks 14 and 15 should be repeated at least until the formed loops conceal the holes.

The knit fabric and knitting method of the invention are not limited to the foregoing embodiment alone, and the knitting start portion and knitting end portion may be other than rib knitting, and the loop exchange direction or sequence between the needle beds may be changed, depending on whether the knit main part is used in the outer surface of the knit product or in the inner surface. The needle beds and needles used in knitting may be changed as required, as far as not departing from the true spirit of the invention.

What is claimed is:

1. A knit product knitted by using a flat knitting machine possessing at least a pair of first and second needle beds disposed in front and rear positions, said knit product comprising a rib knit knitted start part, a knitted main part and a rib knit knitted end part, said knit product including open wales between the main part and the knitted end part, wherein the knitted start part and the knitted end part are knitted in the same knitting direction on opposite beds, and the main part is knitted subsequent to the knitted start part, two overlapped adjacent loops of a final course of the main part and one loop of a final course of the knitted end part are joined, sequential loops are formed in at least one additional course, edge parts of the sequentially formed loops are held fast by using a thermofusible yarn for heat treatment to prevent unravelling and the sequentially formed loops cover the open wales that are formed between the main part and the knitting end part by taking advantage of natural curling properties of the knitted loops.

* * * * *